US007452060B2

(12) United States Patent
Nakamura et al.

(10) Patent No.: US 7,452,060 B2
(45) Date of Patent: Nov. 18, 2008

(54) INK-JET PRINTING UNIT HAVING PLATE-STACKED TYPE PRINTING HEAD AND METHOD OF PRODUCING THE SAME

(75) Inventors: Hirotake Nakamura, Nagoya (JP); Atsushi Ito, Nagoya (JP); Kazuaki Iwatsuki, Higashiura-cho (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 376 days.

(21) Appl. No.: 11/061,873

(22) Filed: Feb. 22, 2005

(65) Prior Publication Data

US 2005/0195249 A1 Sep. 8, 2005

(30) Foreign Application Priority Data

Mar. 4, 2004 (JP) ..... 2004-060305

(51) Int. Cl.
*B41J 2/045* (2006.01)
*B41J 2/15* (2006.01)

(52) U.S. Cl. ..... 347/71; 347/40

(58) Field of Classification Search ..... 347/37, 347/39, 40, 71, 8

See application file for complete search history.

(56) References Cited

U.S. PATENT DOCUMENTS 5,696,541 A * 12/1997 Akahane et al. ..... 347/8
5,821,961 A 10/1998 Sato
6,092,887 A * 7/2000 Tanino et al. ..... 347/37
6,431,683 B1 8/2002 Ho et al.
6,679,595 B2 1/2004 Yamada et al.
2002/0105567 A1 8/2002 Yamada et al.
2003/0227516 A1 12/2003 Yamaguchi et al.

FOREIGN PATENT DOCUMENTS

JP A 2002-234144 8/2002
JP A 2002-254610 9/2002

* cited by examiner

*Primary Examiner*—Stephen D Meier
*Assistant Examiner*—Geoffrey Mruk
(74) *Attorney, Agent, or Firm*—Oliff & Berridge, PLC

(57) ABSTRACT

An ink-jet printing unit for an ink-jet printing apparatus, including: an ink-jet printing head including a nozzle plate having a multiplicity of nozzle holes which are arranged in at least one row and from which ink is ejected, and a plurality of intermediate plates which are superposed on the nozzle plate and which provide ink passages communicating with the nozzle holes; and a head holder which holds the ink-jet printing head, wherein the ink-jet printing head has, on an outer side surface thereof, a plurality of reference portions on the basis of which the ink-jet printing head is positioned relative to the head holder in fixing the ink-jet printing head to the head holder.

13 Claims, 11 Drawing Sheets

INK-JET PRINTING UNIT HAVING PLATE-STACKED TYPE PRINTING HEAD AND METHOD OF PRODUCING THE SAME

This application is based on Japanese Patent Application No. 2004-060305 filed on Mar. 4, 2004, the contents of which are incorporated hereinto by reference.

BACKGROUND OF THE INVENTION

1. Field of the Invention

The present invention relates to an ink-jet printing unit having a plate-stacked type ink-jet printing head and a method of producing the same.

2. Discussion of Related Art

As an ink-jet printing head for printing, on print media such as printing sheets, images, characters, etc., by ejecting ink droplets from nozzle holes, there is conventionally known an ink-jet printing head in which are superposed a plate having a multiplicity of nozzle holes formed therethrough and arranged in rows, a plurality of plates which provide ink passages, and a piezoelectric actuator which gives vibration or oscillation for ink ejection for each nozzle hole.

Where the thus constructed printing head is mounted on a main body of a printing apparatus, the printing head is first fixed to a head holder, and the head holder is then mounted on the main body of the printing apparatus. Accordingly, the printing head needs to be fixed to the head holder with high positioning accuracy. Namely, positions of the nozzle holes with respect to the head holder influence print positions on the print media, and inclination of the nozzle holes relative to a nominal direction influences printing of the images per se. Accordingly, if the printing head can be fixed to the head holder with high positioning accuracy, it is possible to perform a high-quality printing operation.

The nozzle holes need to be formed with high accuracy. In addition, the printing head needs to be fixed to the head holder with high positioning accuracy. In the meantime, the printing head is generally formed of a metal while the head holder is generally formed of a synthetic resin. In this case, it is rather difficult to fix the printing head to the head holder with high positioning accuracy, with the printing head and the head holder butted together.

In the light of the above, it is required to first accurately position the printing head on a jig, then accurately position the head holder on the jig with the printing head accurately positioned on the jig, and finally fix the printing head to the head holder.

For the accurate positioning utilizing the jig as described above, there is known a nozzle plate having positioning holes into which positioning pins of a jig are inserted in fixing and bonding the printing head to the head holder. Such a nozzle plate is disclosed in U.S. Pat. No. 6,679,595 (corresponding to JP-A-2002-234144, in paragraphs [0022]-[0024] and FIG. 7, in particular), for instance.

SUMMARY OF THE INVENTION

The nozzle holes having a diameter of 20-30 μm need to be formed with high accuracy, and it is difficult to form, by machining, the positioning holes (reference holes) with accuracy as high as that in forming the nozzle holes. Further, the positioning by inserting the positioning pins into the positioning holes requires a clearance between each positioning holes and each positioning pin, making it difficult to assure high accuracy. Moreover, the reference holes into which the positioning pins are inserted need to have a size considerably larger than that of the nozzle holes. Where the nozzle holes and the reference holes are both formed by laser working, the nozzle holes and the reference holes must be formed independently of or separately from each other, leading to a cost increase.

It is therefore a first object of the present invention to provide an ink-jet printing unit having a printing head which has, on its outer side surface, a plurality of reference portions that permit highly accurate and economical positioning of the printing head. It is a second object of the present invention to provide a method of producing the ink-jet printing unit.

The first object indicated above may be achieved according to a first aspect of the present invention, which provides an ink-jet printing unit for an ink-jet printing apparatus, comprising: an ink-jet printing head including a nozzle plate having a multiplicity of nozzle holes which are arranged in at least one row and from which ink is ejected, and a plurality of intermediate plates which are superposed on the nozzle plate and which provide ink passages communicating with the nozzle holes; and a head holder which holds the ink-jet printing head, wherein the ink-jet printing head has, on an outer side surface thereof, a plurality of reference portions on the basis of which the ink-jet printing head is positioned relative to the head holder in fixing the ink-jet printing head to the head holder.

In the ink-jet printing unit constructed according to the above-indicated first aspect of the invention, the ink-jet printing head has, on its outer side surface, a plurality of reference portions on the basis of which the printing head is positioned relative to the head holder in fixing the printing head to the head holder. This arrangement permits highly accurate and economical positioning of the printing head, in particular, the nozzle plate, relative to the head holder. Further, in the present arrangement, the positioning holes formed in the conventional nozzle plate need not be formed, so as to permit the ink-jet printing unit to be manufactured at a reduced cost. Moreover, instead of the conventional positioning by inserting the positioning pins into the positioning holes, the positioning according to the present arrangement is carried out by contact of the plurality of reference portions each in the form of a flat surface, for instance, with respective positioning members (e.g., positioning pins), thereby assuring high positioning accuracy.

The second object indicated above may be achieved according to a second aspect of the present invention, which provides a method of producing an ink-jet printing unit for an ink-jet printing apparatus which comprises: an ink-jet printing head including a nozzle plate having a multiplicity of nozzle holes which are arranged in at least one row and from which ink is ejected, and a plurality of intermediate plates which are superposed on the nozzle plate and which provide ink passages communicating with the nozzle holes; and a head holder which holds the ink-jet printing head, the method comprising: positioning the ink-jet printing head on a jig by a plurality of positioning members of the jig on the basis of a plurality of reference portions provided on an outer side surface of the ink-jet printing head; positioning the head holder on the jig on the basis of a plurality of reference portions which are provided on the head holder and which are utilized in mounting the head holder on a frame of the ink-jet printing apparatus; and fixing the ink-jet printing head positioned on the jig to the head holder positioned on the jig.

According to the method of the present invention, the printing head is positioned on the jig by the positioning members on the basis of the plurality of reference portions provided on the outer side surface of the printing head. Subsequently, the head holder is positioned on the jig on the basis of the plurality of reference portions which are provided thereon and which are utilized in mounting the head holder on the frame of the printing apparatus. Thereafter, the printing head positioned on the jig is fixed to the head holder positioned on the jig. Accordingly, the present arrangement permits the printing head to be positioned on the jig with respect to the head holder with higher accuracy than the conventional arrangement in which the positioning is carried out with the printing head and the head holder butted together. According to this arrangement, the printing head can be fixed to the head holder with high positioning accuracy.

BRIEF DESCRIPTION OF THE DRAWINGS

The above and other objects, features, advantages and technical and industrial significance of the present invention will be better understood by reading the following detailed description of a presently preferred embodiment of the invention, when considered in connection with the accompanying drawings, in which.

DETAILED DESCRIPTION OF THE PREFERRED EMBODIMENT

There will be described in detail a preferred embodiment of the present invention by reference to the accompanying drawings.

Figure 1:
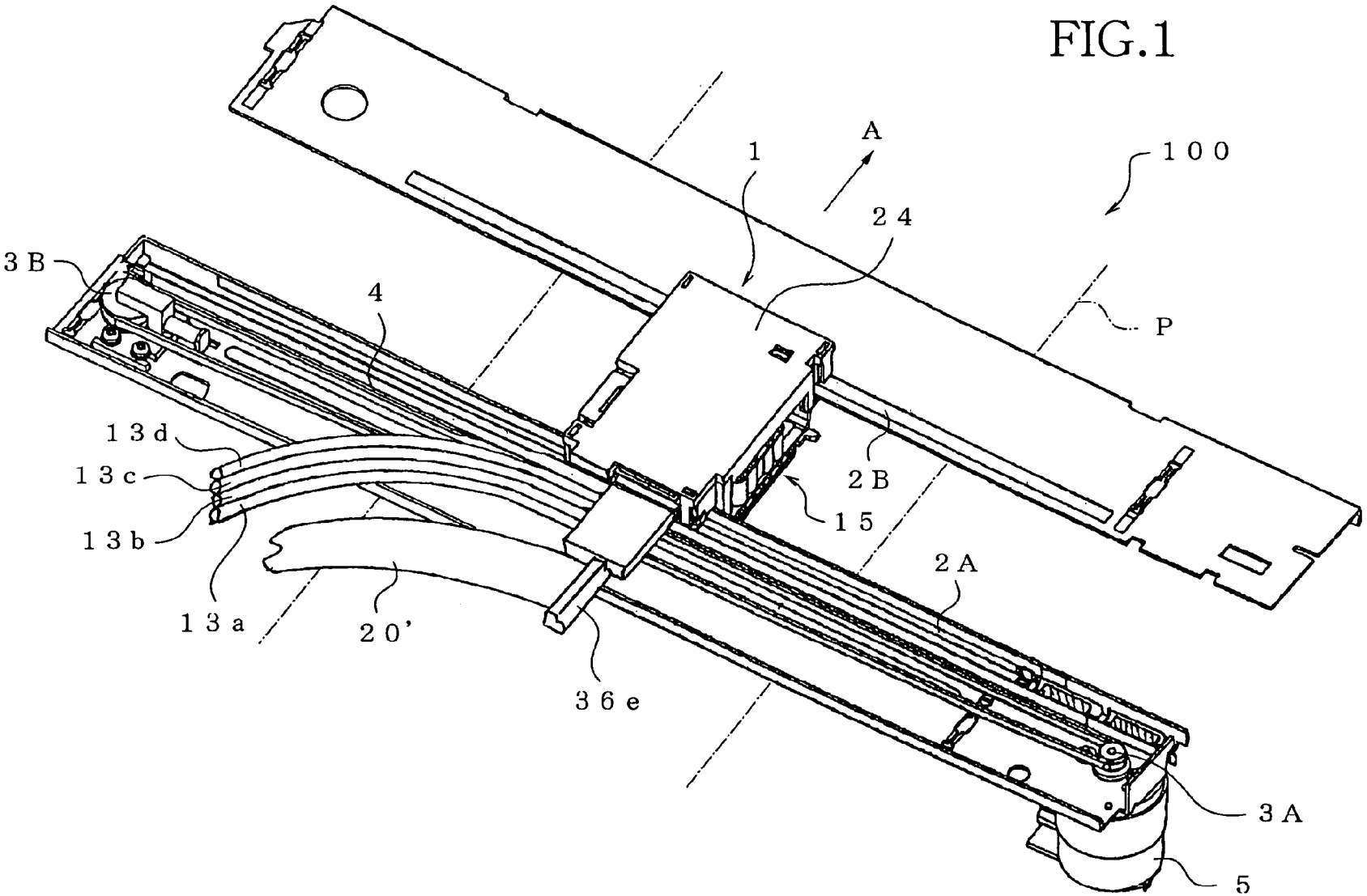
FIG. 1 is a schematic view showing principal parts of an ink-jet printing apparatus to which the principle of the present invention is applied.
Figure 2:
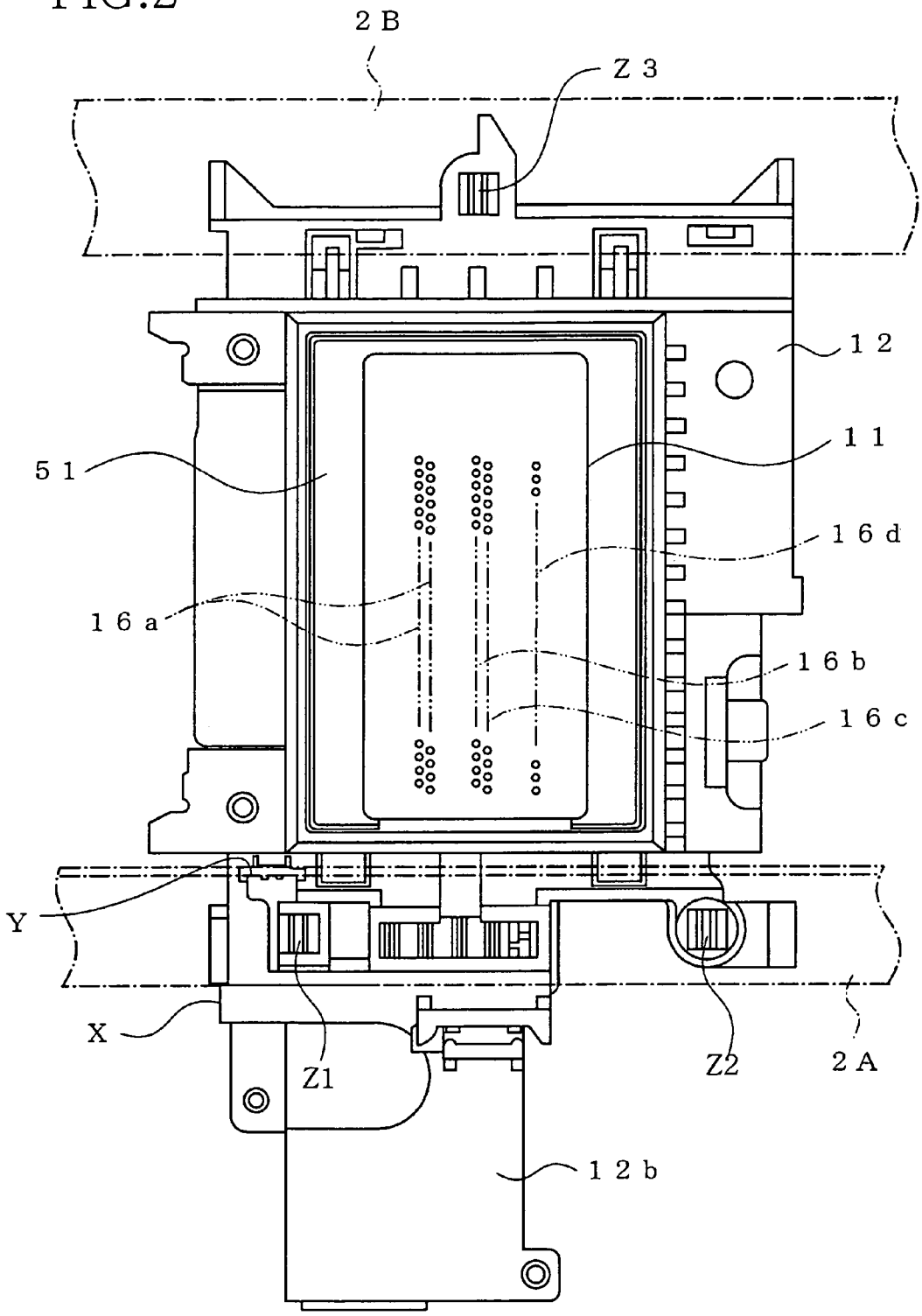
FIG. 2 is a bottom plan view of an ink-jet printing unit of the apparatus of FIG. 1.
Figure 3:
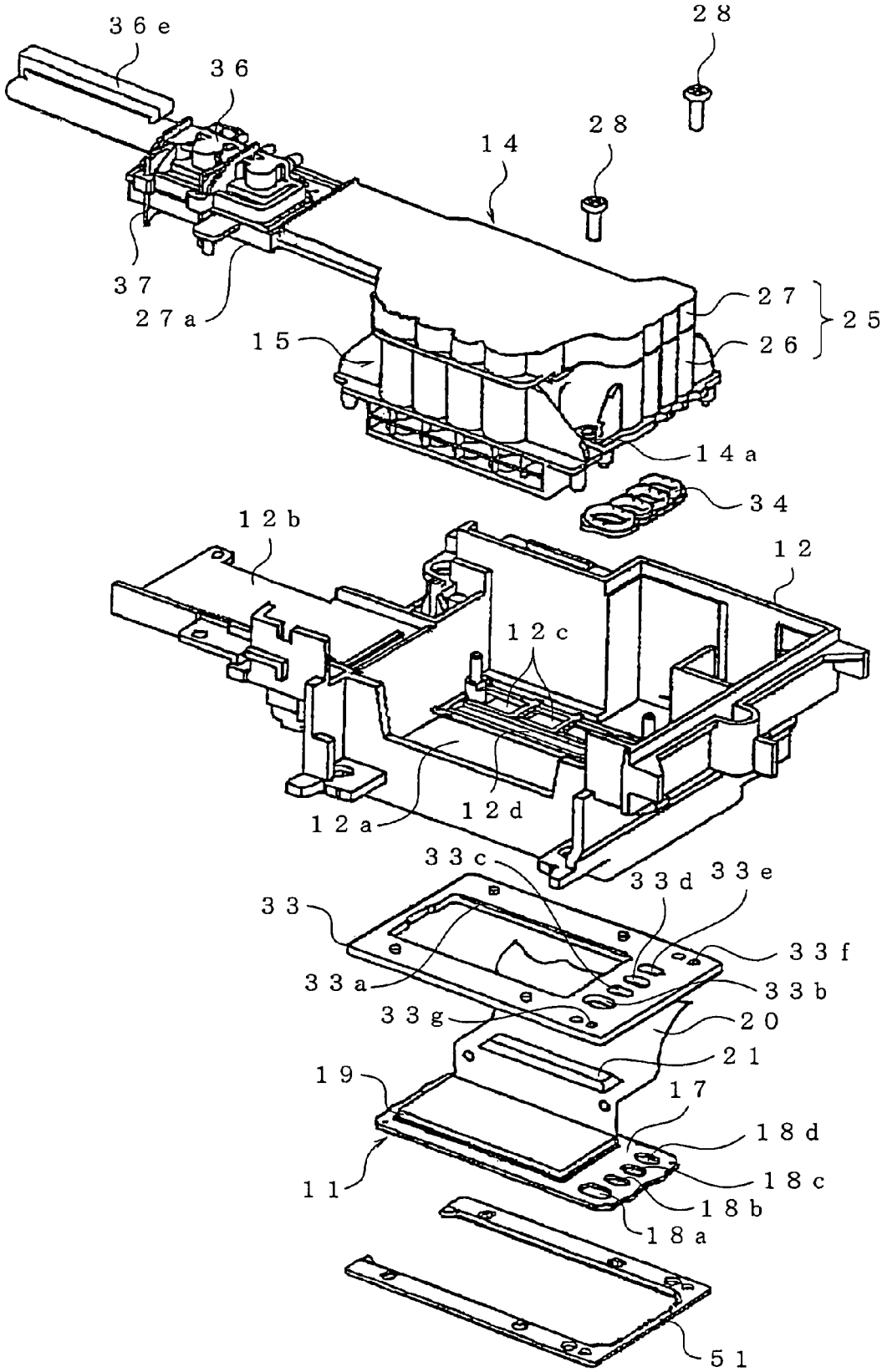
FIG. 3 is an exploded perspective view of the ink-jet printing unit of FIG. 2.

FIG. 1 is a schematic view showing principal parts of an ink-jet printing apparatus 100 constructed according to the embodiment of the invention. FIG. 2 is a bottom plan view of an ink-jet printing unit 1 of the printing apparatus 100. FIG. 3 is an exploded perspective view of the ink-jet printing unit 1.

As shown in FIGS. 1-3, the ink-jet printing apparatus 100 includes the ink-jet printing unit 1 having a thin plate-stacked printing head 11 of an ink-jet type for ejecting inks from nozzle holes, and a head holder 12 on which the printing head 11 is mounted and which is formed of a synthetic resin material. In the present ink-jet printing apparatus 100, the inks are supplied from respective ink tanks (not shown) via respective ink supply tubes 13 (13*a*-13*d*) to a damper device 14 mounted on the head holder 12 and temporalily stored therein. The damper device 14 will be described in greater detail. The inks stored in the damper device 14 are supplied to the printing head 11. The ink tanks are removably attached to a frame (not shown) of the printing apparatus and store the inks to be supplied to the printing head 11. The amount of inks stored in the ink tanks is larger than that stored in the damper device 14. Although the ink tanks are not specifically shown, a plurality of ink tanks respectively for a black ink, a cyan ink, a magenta ink, and a yellow ink are provided in the present embodiment for full-color printing.

The head holder 12 is sidably supported by a rear guide member 2A and a front guide member 2B which are parallel to each other in a frontward and backward direction of the frame of the printing apparatus 100 and which extend in a leftward and rightward direction of the frame. The rear guide member 2A has a generally "L"-shape in cross section in a plane perpendicular to a sliding or moving direction of the head holder 12 in which the head holder 12 slides or moves. The front guide member 2B has a horizontal plane extending in the sliding direction. The head holder 12 has two reference portions Z1, Z2 which are to be in contact at surfaces thereof with a horizontal plane of the L-shaped rear guide member 2A and a reference portion Z3 which is to be in contact at a surface thereof with the horizontal plane of the front guide member 2B, whereby the head holder 12 is supported by the two guide members 2A, 2B so as to be parallel to a printing surface of a print medium which will be described. The head holder 12 further has a reference portion Y which is to be in contact at a surface thereof with a vertical plane of the L-shaped rear guide member 2A, whereby the head holder 12 is positioned with respect to the frontward and backward direction including a feeding direction of the print medium in which the print medium is fed. In addition to the reference portions Z1-Z3 and Y, the head holder 12 has a reference portion X in its side surface perpendicular to the sliding direction. The head holder 12 is connected to a portion of an endless timing belt 4 stretched between a drive pulley 3A and a driven pulley 3B. By driving the drive pulley 3A by a drive motor 5, the head holder 12 is arranged to be reciprocated in the leftward and rightward direction of the frame via the timing belt 4 along the rear and front guide members 2A, 2B. The upper portion of the head holder 12 is covered with a cover 24.

Although not specifically shown, a known sheet feeding mechanism is provided to feed a paper sheet P as the print medium in a direction (indicated by an arrow "A" in FIG. 1) perpendicular to the moving direction of the head holder 12 (perpendicular to the leftward and rightward direction of the frame), such that the paper sheet P faces the lower surface of the printing head 11 in a state in which printing can be performed on the paper sheet P. There are also provided an ink-receiving portion which receives inks ejected from the printing head 11 in a flushing operation periodically performed during the printing operation for preventing clogging of nozzle holes, and a maintenance unit which performs a cleaning operation for cleaning the surface of the printing head 11 in which the nozzle holes are formed, a restoring treatment in which a selected one or ones of different colors of inks is/are sucked, and a bubble (air) removal treatment for removing bubbles (air) stored in a damper device 14 which will be explained in greater detail.

As shown in FIG. 3, at one of longitudinally opposite ends of the printing head 11, four ink supply holes 18*a*-18*d* of a cavity unit 17 respectively for the four colors are formed in a row so as to be open in the upper surface of the printing head 11. The inks supplied from the respective ink supply holes 18*a*-18*d* are fed to respective nozzle holes 16*a*-16*d* via respective ink passages provided within the cavity unit 17 for the respective inks. By driving a piezoelectric actuator 19, the inks are ejected from the respective nozzle holes 16*a*-16*d*. The area of opening of the ink supply hole 18*a* for the black ink (BK) is made larger than that of the other ink supply holes 18*b*-18*d* for the cyan ink (C), the yellow ink (Y), and the magenta ink (M), respectively.

In the printing head 11, the piezoelectric actuator 19 has an outer contour in its plan view which is smaller than that of the cavity unit 17, so that, when the piezoelectric actuator 19 is superposed or stacked on the upper surface of the cavity unit 17, the peripheral portion of the upper surface of the cavity unit 17 which surrounds the piezoelectric actuator 19 and in a part of which the ink supply holes 18*a*-18*d* are formed is exposed in the upper surface of the printing head 11.

Figure 7:
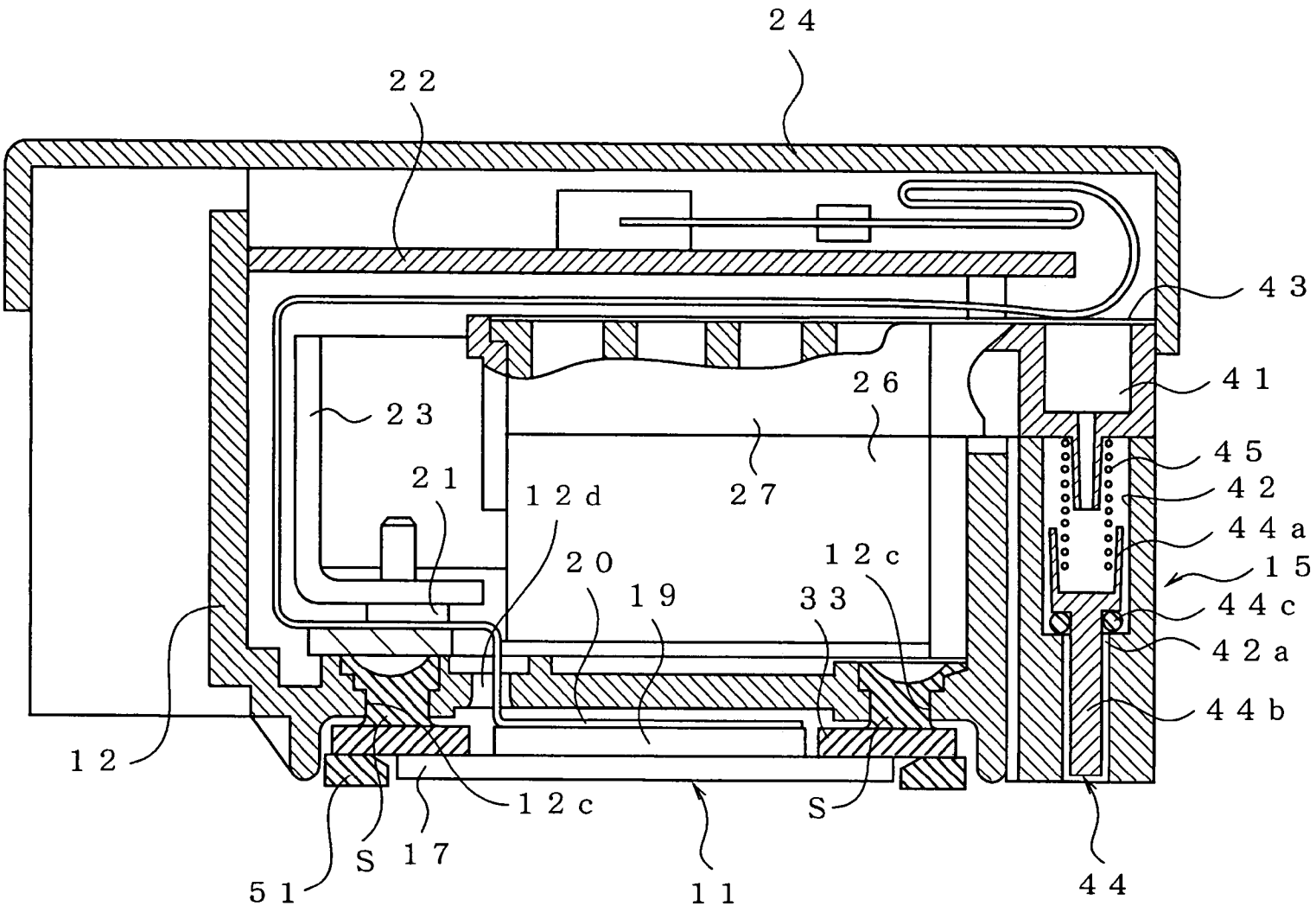
FIG. 7 is a cross sectional view taken along line 7-7 in FIG. 4.

On the upper surface of the piezoelectric actuator 19, a flexible flat cable 20 is fixed at its proximal portion for applying a voltage to the piezoelectric actuator 19. The flexible flat cable 20 has a driver IC 21 and is electrically connected to a printed board 22 (FIG. 5) disposed on the damper device 14. The printed board 22 is arranged to be connected to a printed board (not shown) of the main body of the printing apparatus 100 via another flexible flat cable. Because the driver IC 21 generates a heat, a heat sink 23 formed of an aluminum alloy is disposed so as to be held in pressing contact with the driver IC 21 as shown in FIG. 7 for cooling the same 21, so that the driver IC 21 is spontaneously cooled down through the heat sink 23.

As shown in FIGS. 4-7, the damper device 14 includes a plurality of mutually independent damper chambers for the respective inks of different colors by dividing an inside space of a casing 25 of the damper device 14. More specifically, the plurality of damper chambers are a black-ink (BK) damper chamber 31*a*, a cyan-ink (C) damper chamber 31*b*, a yellow-ink (Y) damper chamber 31*c*, and a magenta-ink (M) damper chamber 31*d*, The casing 25 is constituted by a box-like lower casing member 26 having an upper opening and an upper casing member 27 which is fixed to the lower casing member 26 so as to close the upper opening of the lower casing member 26. The lower and upper casing members 26, 27 are both formed by injection molding of a synthetic resin material and fluid-tightly fixed to each other by ultrasonic welding, for instance. The thus fixed lower and upper casing members 26, 27 define the above-described damper chambers 31*a*-31*d*. Each damper chamber 31*a*-31*d* may be given by a single space or a plurality of divided spaces. Each of the damper chambers 31*a*-31*d* communicates at one end thereof with a corresponding one of ink outlets 32*a*-32*d* for the respective inks.

The head holder 12 has a bottom plate portion 12*a* which is generally parallel to the upper surface of the printing head 11. The printing head 11 is bonded to the lower surface of the bottom plate portion 12*a* with a reinforcement frame member 33 interposed therebetween. The reinforcement frame member 33 will be described. On the upper side of the bottom plate portion 12*a* of the head holder 12, there are disposed the damper device 14 for temporarily storing the inks therein, and an air discharger 15 (FIG. 7) for discharging the air stored in the damper chambers 31*a*-31*d* of the damper device 14.

In the lower surface of the printing head 11, there are formed two rows of black-ink (BK) nozzle holes 16*a*, a row of cyan-ink (C) nozzle holes 16*b*, a row of a yellow-ink (Y) nozzle holes 16*c*, and a row of the magenta-ink (M) nozzle holes 16*d*, which rows are arranged in order from the left to the right as seen in the bottom plan view of the printing head 11 of FIG. 2. These rows of the nozzle holes 16*a*-16*d* extend in a direction perpendicular to the moving direction of the head holder 12 (i.e., perpendicular to a primary scanning direction). The nozzle holes 16*a*-16*d* are formed in the lower surface of the printing head 11 so as to be open downwardly, such that the nozzle holes 16*a*-16*d* are opposed to the upper surface of the paper sheet P on which printing is performed.

The ink outlets 32*a*-32*d* of the damper device 14 are arranged in a row on the lower surface of the lower casing member 26 so as to be open downwardly and located at a height position lower than that of the bottom plate portion 12*a* of the head holder 12. The ink outlets 32*a*-32*d* are positioned so as to respectively correspond to the ink supply holes 18*a*-18*d* which are open in the upper surface of the cavity unit 17 (the printing head 11). The printing head 11 is bonded to the lower side of the head holder 12 with the reinforcement frame member 33 interposed therebetween, so that the ink outlets 32*a*-32*d* are held in communication with the respective ink supply holes 18*a*-18*d* of the cavity unit 17 through respective ink passage holes 33*b*-33*e* formed in a row through the reinforcement frame member 33, via an elastic sealing member 34 such as a rubber packing.

The reinforcement frame member 33 has a flat plate-like member along the upper surface of the printing head 11 and has a central opening 33*a* whose size in its plan view is slightly larger than that of the outer contour of the piezoelectric actuator 19 and smaller than that of the outer contour of the cavity unit 17. Accordingly, the reinforcement frame member 33 is bonded and fixed to the upper surface of the cavity unit 17 such that the piezoelectric actuator 19 and the flexible flat cable 20 are positioned or fitted in the central opening 33*a*.

The reinforcement frame member 33 is formed of a metal such as SUS430 and has a thickness and a rigidity which are larger and higher than those of the cavity unit 17. As described above, the reinforcement frame member 33 has, at its longitudinal end corresponding to the ink supply holes 18*a*-18*d* of the cavity unit 17, the ink passage holes 33*b*-33*e* formed therethrough in a row for connecting the ink outlets 32*a*-32*d* of the damper device 14 and the ink supply holes 18*a*-18*d* of the cavity unit 17.

To compensate for a difference in height positions between the lower surface of the printing head 11 and the reinforcement frame member 33 and to protect the printing head 11, a protective cover 51 having a generally U-shape in its plan view is attached to the reinforcement frame member 33 so as to surround the periphery of the printing head 11.

Figure 4:
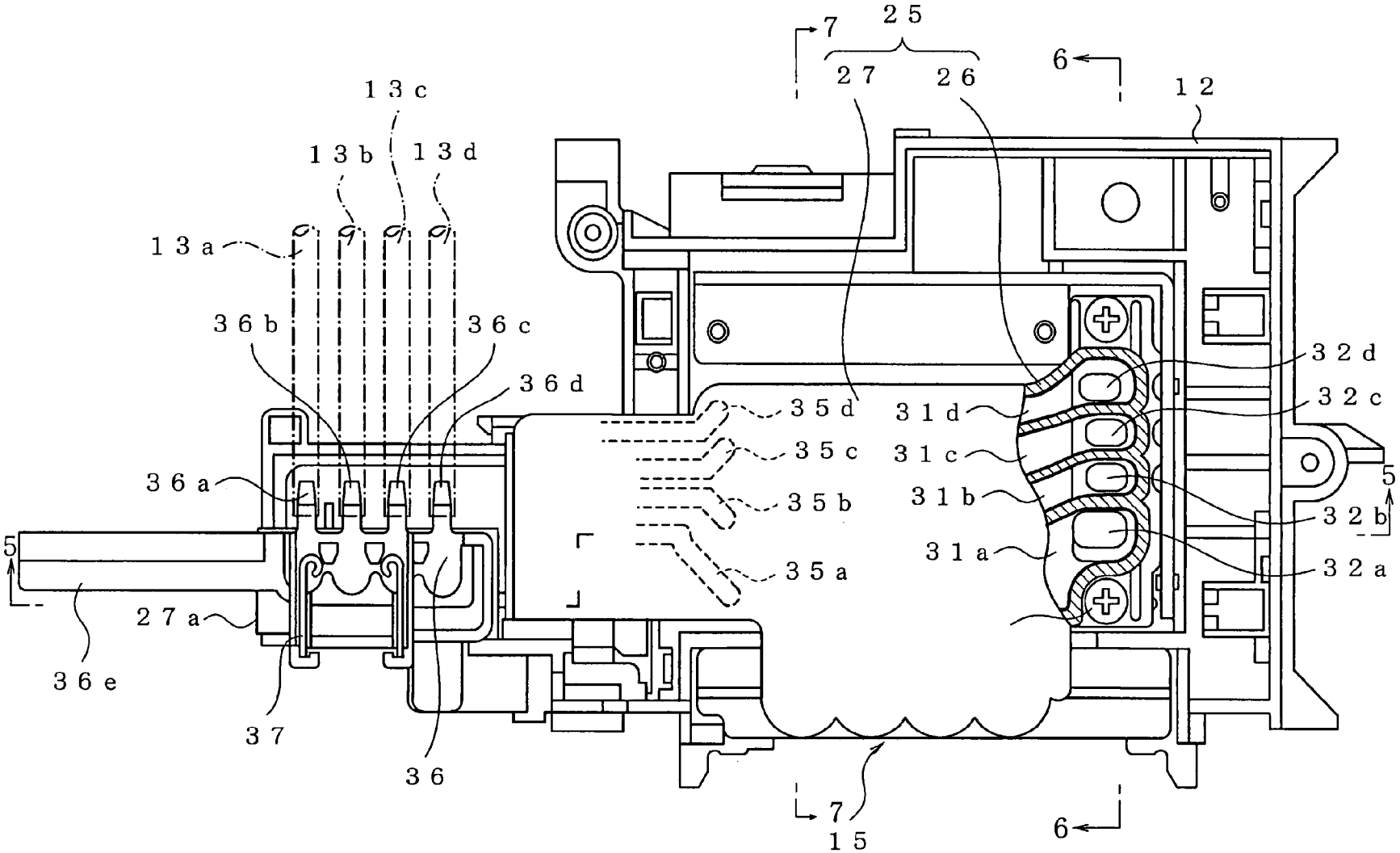
FIG. 4 is a plan view partly in cross section showing the ink-jet printing unit of FIG. 2.
Figure 5:
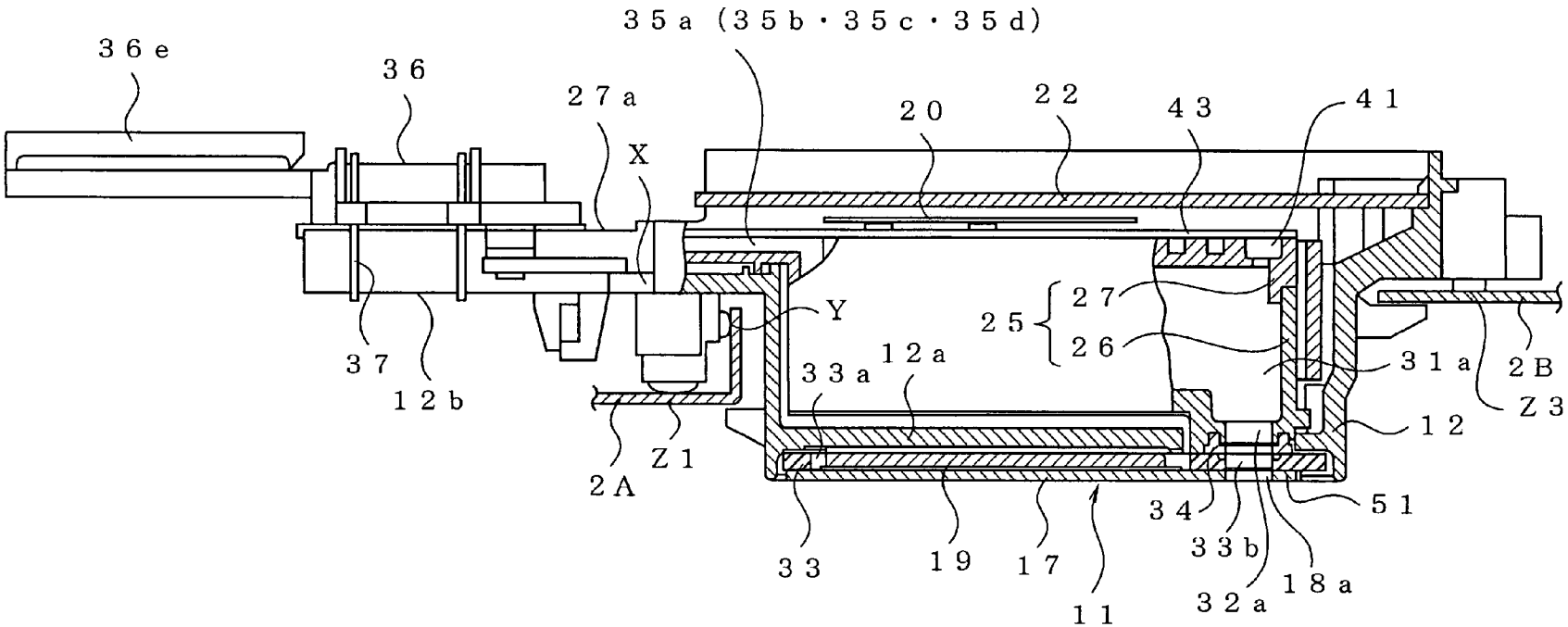
FIG. 5 is a cross sectional view taken along line 5-5 in FIG. 4.

On one of opposite ends of the upper casing member 27 of the casing 25 remote from the ink outlets 32*a*-32*d*, there is provided a flange-like extended portion 27*a* which extends therefrom and in which are formed mutually independent four ink-inlet passages 35*a*-35*d* respectively for the black ink (BK), the cyan ink (C), the yellow ink (Y), and the magenta ink (M), as shown in FIGS. 4 and 5. The downstream ends of the respective ink-inlet passages 35*a*-35*d* are held in communication with the damper chambers 31*a*-31*d*, respectively. On the lower side of the extended portion 27*a* of the upper casing member 27, an extended portion 12*b* of the head holder 12 is formed so as to correspond to the extended portion 27*a*.

On the upper portion at the leading end of the extended portion 27*a*, there is provided, via a sealing member (not shown) such as a packing, a tube joint 36 having tube connecting portions 36*a*-36*d* for the respective inks of the different four colors. The tube joint 36 is elastically attached to the extended portions 27*a*, 12*b* by means of a spring 37. The downstream ends of respective ink passages within the tube joint 36 are held in communication with the upstream ends of the respective ink-inlet passages 35*a*-35*d*. To each of the tube connecting portions 36*a*-36*d* of the tube joint 36, each of the ink supply tubes 13*a*-13*d* is removably connected at one end thereof opposite to the other end communicating with the corresponding ink tank. The tube joint 36 has an integrally formed retaining portion 36*e* for retaining a flexible flat cable 20' which connects the printed board 22 to the printed board of the main body of the printing apparatus 100.

On the upper surface of the upper casing member 27, there are formed mutually independent four air discharge passages 41 for the respective inks of the four different colors. Each air discharge passage 41 is in the form of a recess and communicates at one end thereof with an upper space of the corresponding damper chamber 31*a*-31*d*. Each air discharge passage 41 extends along the upper surface of the upper casing member 27 and communicates at the other end with an upper end of a corresponding one of air discharge holes 42 formed through the lower casing member 26 and provided for the respective inks. The upper openings of the air discharge passages 41 are covered with a flexible film 43.

Figure 6:
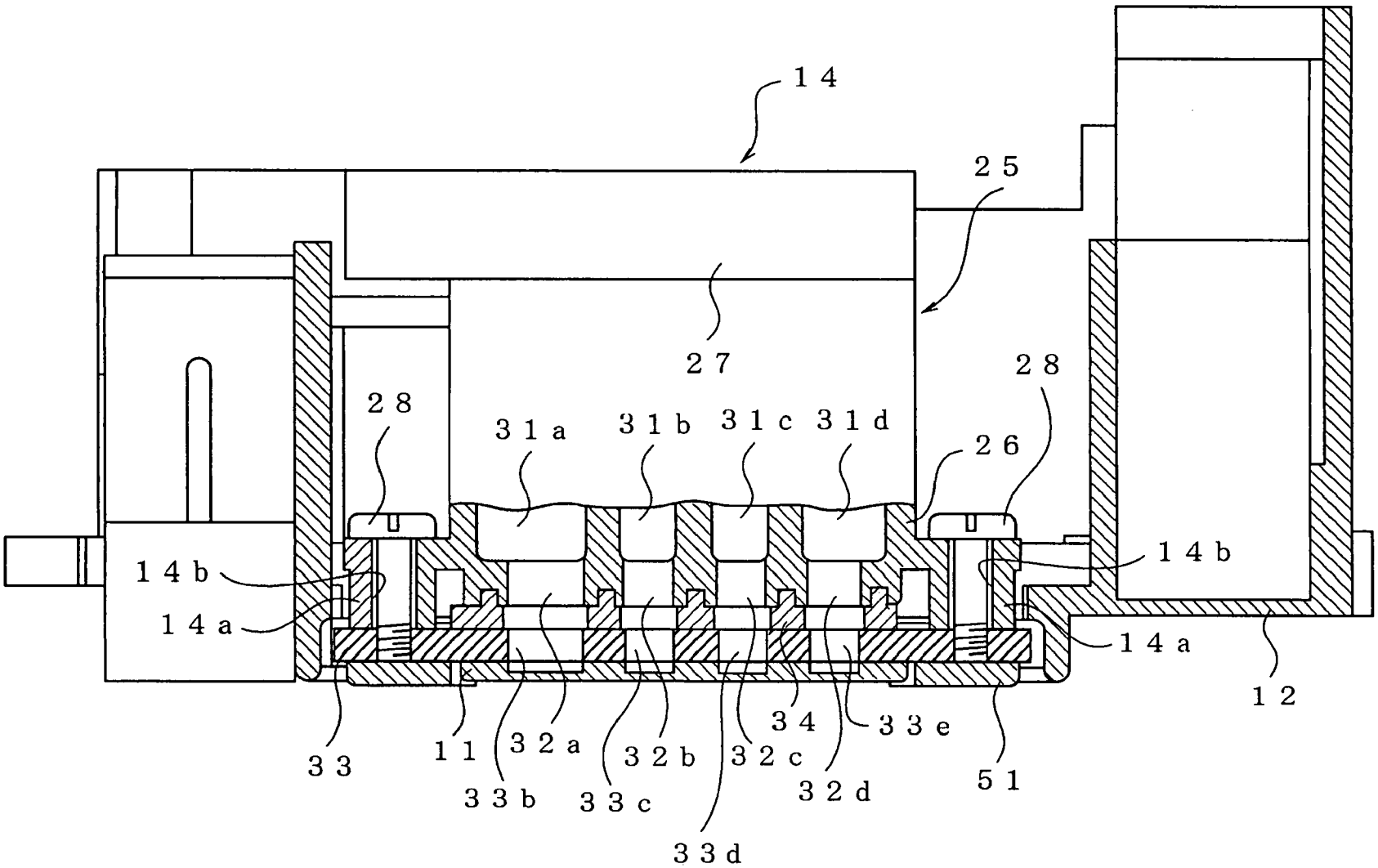
FIG. 6 is a cross sectional view taken along line 6-6 in FIG. 4.

As shown in FIGS. 3 and 6, the reinforcement frame member 33 has tapped or threaded holes 33*f*, 33*g* formed at two corner portions thereof. The damper device 14 is provided with fixing portions 14*a* which protrude outwardly from its periphery so as to correspond to the tapped holes 33*f*, 33*g*. The fixing portions 14*a* are formed with through-holes 14*b*. Two screws 28 are respectively screwed into the tapped holes 33*f*, 33*g* via the through-holes 14*b*, whereby the damper device 14 is fixed to the reinforcement frame member 33 which is bonded and fixed to the lower surface of the bottom plate portion 12*a* of the head holder 12.

As shown in FIG. 7, a valve member 44 is slidably provided in each air discharge hole 42, for allowing the air discharge hole 42 to communicate with the atmosphere or inhibiting the air discharge hole 42 from communicating with the atmosphere. The valve member 44 has a large-diameter valve portion 44*a*, a small-diameter rod portion 44*b* integrally connected to the lower end of the valve portion 44*a*, and a sealing member 44*c* mounted on the upper end of the rod portion 44*b* so as to be in contact with the valve portion 44*a*. The valve portion 44*a* is arranged to open or close a communication hole 42*a* of the air discharge hole 42. Further, a spring or biasing member 45 is disposed in each air discharge hole 42 to bias the valve portion 44*a* in such a direction that causes the communication hole 42*a* to be closed.

In a normal state, the valve member 44 is placed in its closed state in which the valve member 44 is constantly pressed or biased downwardly by the spring member 45 so as to close the communication hole 42*a* via the sealing member 44*c*. When the head holder 12 is moved to its home position, the rod portion 44*b* is pushed up by a projection of the maintenance unit (not shown), so that the valve member 44 is placed in its open state in which the valve portion 44*a* and the sealing member 44*c* are separated away from the communication hole 42*a*. In this state, the air bubbles stored in the damper chambers 31*a*-31*d* of the damper device 14 are sucked by actuating a suction pump (not shown) and discharged out of the damper device 14 into the atmosphere. The above-described air discharger 15 is thus constituted.

The inks to be supplied from the respective ink tanks to the printing head 11 via the respective ink supply tubes 13*a*-13*d* are temporarily stored in the damper chamber 31*a*-31*d* provided in the route of the flow of each ink, whereby the air bubbles are separated from the inks and floated on the upper surfaces of the inks. The separated air bubbles stored in the upper spaces of the damper chambers 31*a*-31*d* are sucked and discharged by the suction pump.

Figure 8:
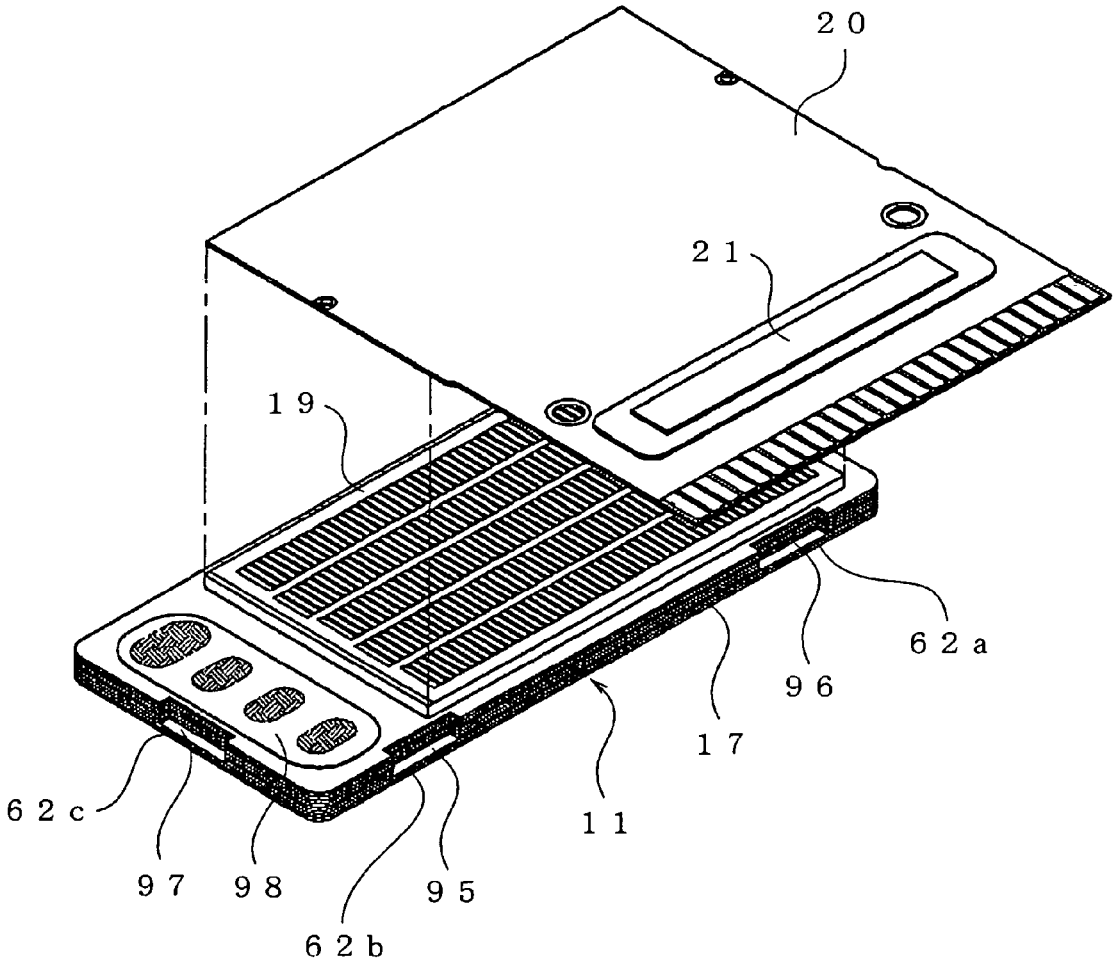
FIG. 8 is a perspective view showing relationship between a printing head of the ink-jet printing unit and a flexible flat cable.
Figure 9:
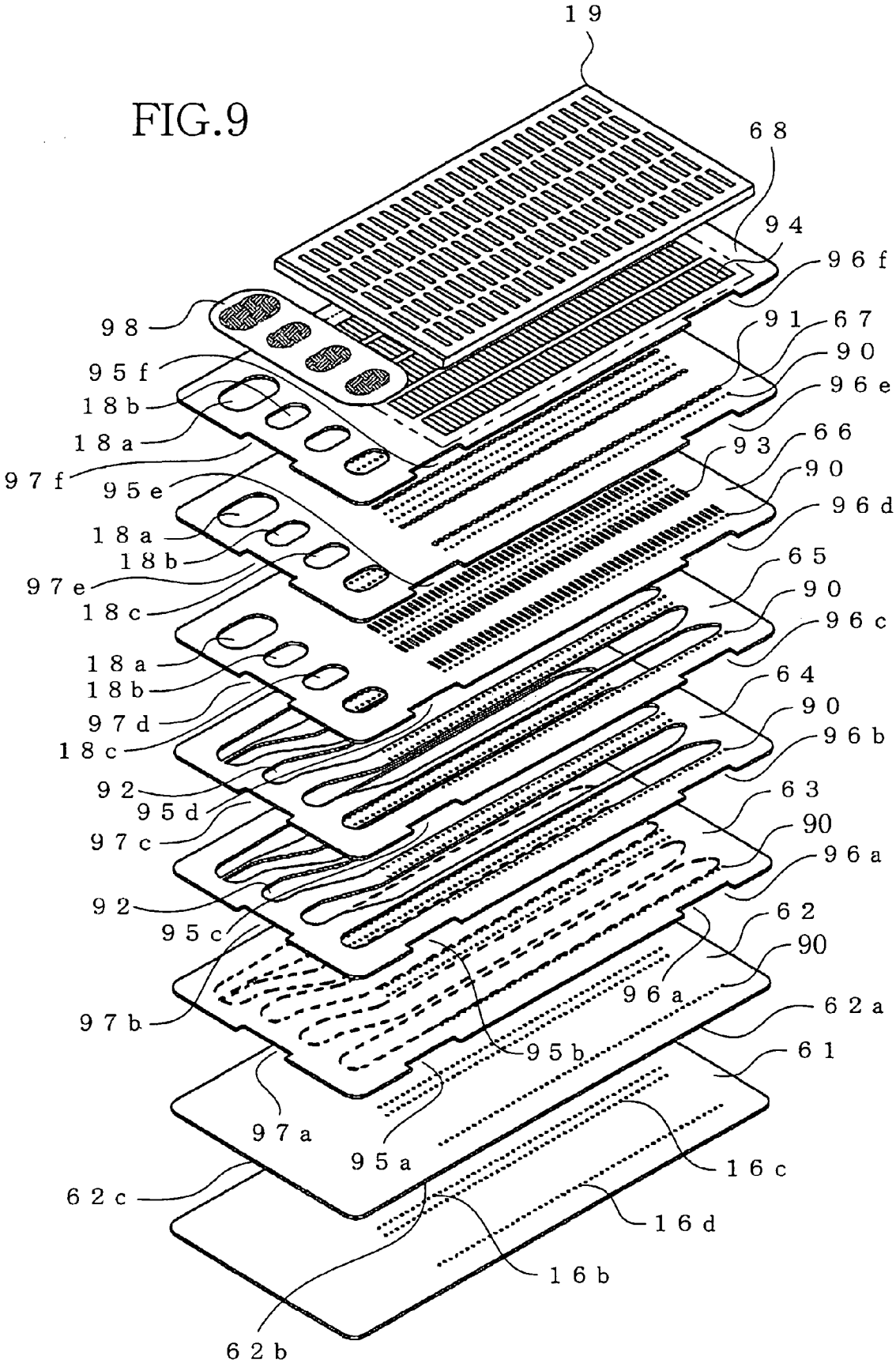
FIG. 9 is an exploded perspective view of a cavity unit.

By referring next to FIGS. 8 and 9, there will be explained the cavity unit 17 of the printing head 11. As shown in FIGS. 8 and 9, the cavity unit 17 includes: a nozzle plate 61 having the multiplicity of the nozzle holes 16*a*-16*d* formed therethrough and arranged in rows; and a plurality of intermediate plates 62-68 superposed or stacked in order on the nozzle plate 61 for providing ink passages. More specifically, the plurality of intermediate plates include a first spacer plate 62, an auxiliary plate 63, two manifold plates 64, 65, a second spacer plate 66, a third spacer plate 67, and a base plate 68. These plates 61-68 are superposed on and bonded to one another with an adhesive.

The nozzle plate 61 is formed of a synthetic resin such as a polyimide resin while the intermediate plates 62-68 are formed of a nickel alloy steel and have respective thickness values of about 50-150 μm. The multiplicity of nozzle holes 16*a*-16*d* each having an extremely small diameter (about 25 μm in this embodiment) are formed through the thickness of the nozzle plate 61 at an extremely small spacing pitch. As described above, the nozzle holes 16*a*-16*d* are arranged in five rows extending in the longitudinal direction of the nozzle plate 61, such that the nozzle holes of adjacent two rows are arranged in a zigzag pattern.

The four ink supply holes 18*a*-18*d* are formed through the base plate 68, the third spacer plate 67, and the second spacer plate 66 at one longitudinal end of each plate 68, 67, 66, so as to be aligned with one another in the direction of stacking of the plates 68, 67, 66. As described above, the four ink inlets 32*a*-32*d* of the damper device 14 are respectively connected to the four ink supply holes 18*a*-18*d*. In the ink passages from the ink supply holes 18*a*-18*d* to the nozzle holes 16*a*-16*d*, the inks are first fed from the ink supply holes 18*a*-18*d* to respective common chambers 92 partially defined by the two manifold plates 64, 65, and then distributed to one end of the respective pressure chambers 94 formed in the base plate 68 via respective connection passages 93 of the second spacer plate 66 and respective communication holes 91 of the third spacer plate 67. By driving the piezoelectric actuator 19, the inks are delivered from the respective pressure chambers 94 to the nozzle holes 16*a*-16*d* corresponding to the pressure chambers 94 via through-holes 90 formed through the first spacer plate 62, the auxiliary plate 63, the two manifold plates 64, 65, and the third spacer plate 67.

The first spacer plate 62 superposed immediately on the nozzle plate 61 has, on its outer side surface, a plurality of reference portions 62*a*, 62*b*, 62*c* on the basis of which the printing head 11 is fixed to the head holder 12. The plates 63-68 other than the first spacer plate 62 respectively have recessed portions in the form of cutouts 95*a*-95*f*, 96*a*-96*f*, and 97*a*-97*f* each having a size that does not lower the rigidity of the plates 63-68. The nozzle plate 61 and the intermediate plates 63-38 are superposed on and bonded to one another to provide the cavity unit 17 having cutouts 95, 96, 97, as shown in FIG. 8. The plate-stacked type cavity unit 17 constructed as described above has, in its plan view, a substantially rectangular shape which is elongate in the direction in which the rows of the nozzle holes 16*a*-16*d* extend. Accordingly, two 95, 96 of the three cutouts 95-97 are located at respective two positions of the outer side surface of the cavity unit 17 (the printing head 11) at its long side while one 97 of the three cutouts 95-97 is located at a position of the outer side surface of the cavity unit 17 (the printing head 11) at its short side. The first spacer plate 62 may be configured such that only portions of its outer side surface respectively corresponding to the three cutouts 95, 96, 97 are made as the reference portions 62*a*, 62*b*, 62*c*. The other portions of the outer side surface of the first spacer plate 62 may have any shape. Instead of forming the cutouts 95, 96, 97 in the plates 63-68, at least portions of the outer side surfaces of the plates 63-68 corresponding to the respective reference portions 62*a*, 62*b*, 62*c* or the entire periphery of each plate 63-68 may be located inwardly of the reference portions 62*a*, 62*b*, 62*c*. Similarly, the nozzle plate 61 has a size smaller than that of the first spacer plate 62 such that the periphery of the nozzle plate 61 is located inwardly of the reference portions 62*a*, 62*b*, 62*c*.

On the base plate 68, a filter 98 is bonded to cover the ink supply holes 18*a*-18*d* for removing foreign matter contained in the inks. The formation of the recesses, through-holes, etc., which provide the common ink chambers 92, the through-holes 90, the communication holes 91, the connection passages 93, the pressure chambers 94, etc., is performed by etching, electrical discharge working, plasma working, laser working or the like.

The lower surface of the piezoelectric actuator 19 is entirely covered by an adhesive sheet (not shown) as a bonding agent formed of an ink impermeable synthetic resin, and the piezoelectric actuator 19 is then bonded and fixed to the upper surface of the cavity unit 17 with predetermined positional relationship. The flexible flat cable 20 is superposed and pressed on the upper surface of the piezoelectric actuator 19, whereby variously patterned wires (not shown) of the flexible flat cable 20 are electrically connected to the piezoelectric actuator 19.

Next, there will be explained a method of producing the ink-jet printing unit 1.

<Production of the Printing Head 11>

Figure 10A:
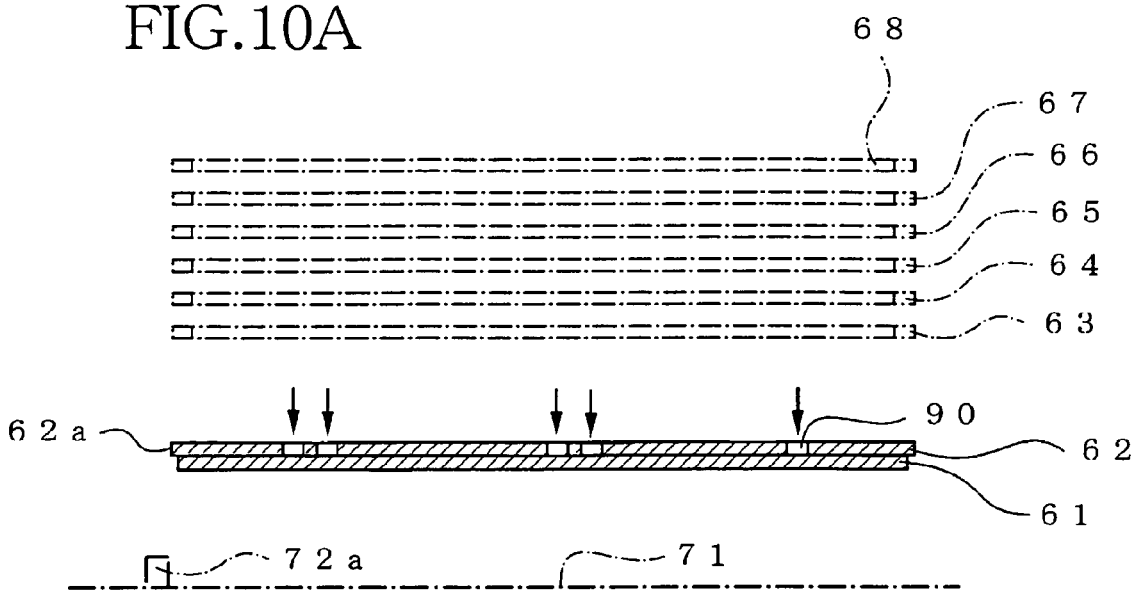
FIG. 10A is a view for explaining formation of nozzle holes in a nozzle plate formed of a synthetic resin and FIG. 10B is a view for explaining formation of nozzle holes in a nozzle plate formed of a metal.

As shown in FIG. 10A, on one surface of the nozzle plate 61 (i.e., on the upper surface of the nozzle plate 61 in the present embodiment), there is bonded the first spacer plate 62 (as one intermediate plate) having a plurality of through-holes 90 as openings formed therethrough so as to correspond to the nozzle holes. The through-holes 90 of the first spacer plate 62 are formed in advance by etching.

With the first spacer plate 62 superposed on and bonded to the upper surface of the nozzle plate 61, the nozzle plate 61 is irradiated with a laser radiation through the plurality of through-holes 90 of the first spacer plate 62, thereby forming the nozzle holes in the nozzle plate 61. The first spacer plate 62 has the reference portions 62*a*, 62*b*, 62*c* formed by etching together with the through-holes 90. Therefore, in the present embodiment, the nozzle holes can be formed on the basis of the through-holes 90 or the reference portions 62*a*, 62*b* 62*c*, assuring formation of the nozzle holes, with high accuracy, at nominal positions with respect to the reference portions 62*a*, 62*b*, 62*c*.

Subsequently, on one surface of the first spacer plate 62 (on the upper surface of the first spacer plate 62 in the present embodiment) which is remote from the nozzle plate 61, the rest of the intermediate plates, i.e., the auxiliary plate 63, the two manifold plates 64, 65, the second spacer plate 66, the third spacer plate 67, and the base plate 68, are superposed or stacked on one another in order and bonded to one another, thereby providing the thin, plate-stacked type cavity unit 17.

On the thus formed cavity unit 17, the piezoelectric actuator 19, the flexible flat cable 20, and the reinforcement frame member 33 are provided, so that the printing head 11 is obtained.

<Fixing of the Printing Head 11 to the Head Holder 12>

Figure 11:
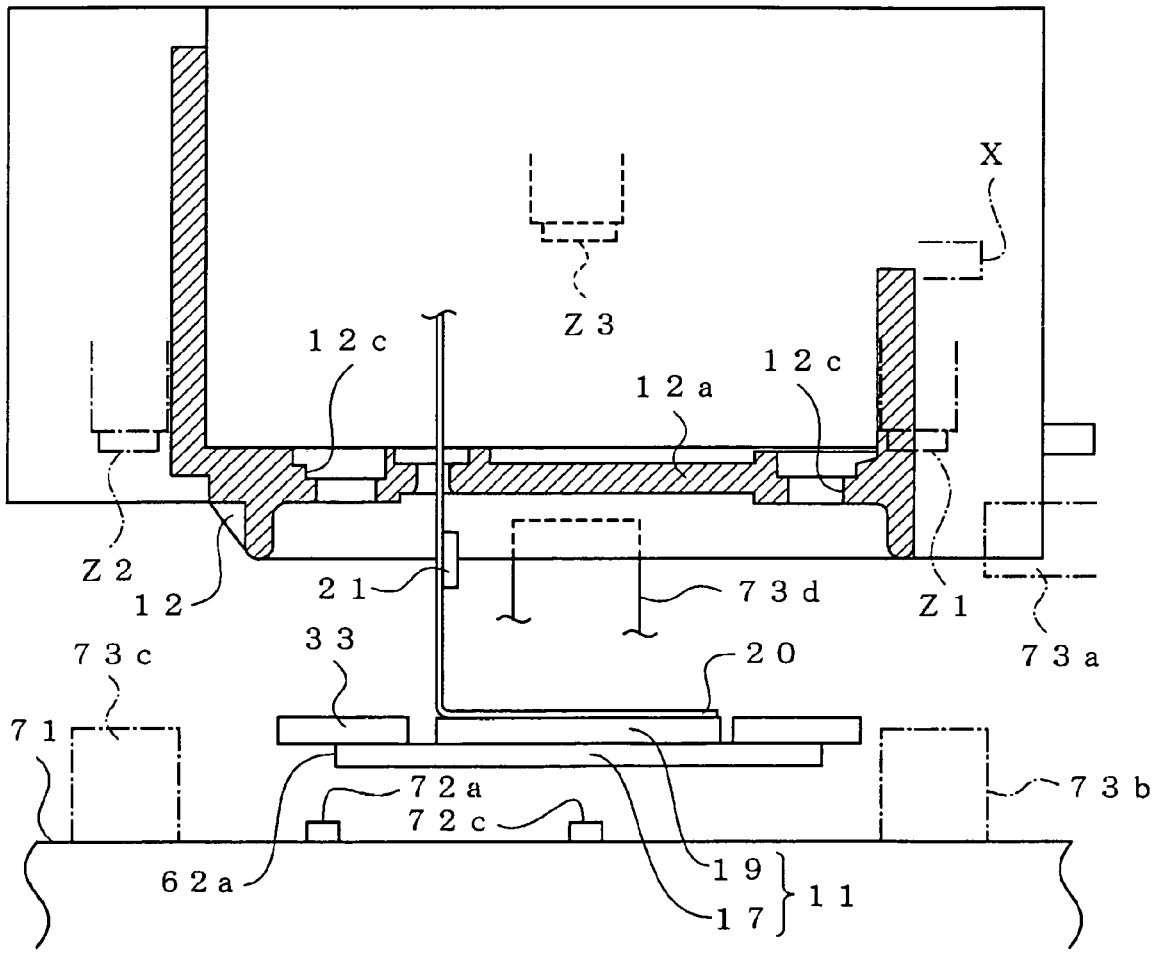
FIG. 11 is a view for explaining a method of producing the ink-jet printing unit.

As shown in FIG. 11, the printing head 11 is initially positioned on a jig 71 by pin-like positioning members of the jig 71, on the basis of the reference portions 62*a*, 62*b*, 62*c* provided on the outer side surface of the first spacer plate 62 (as one intermediate plate) superposed immediately on the nozzle plate 61. Described more specifically, the printing head 11 is placed on the jig 71 such that the three reference portions 62*a*, 62*b*, 62*c* of the first spacer plate 62 contact respective three positioning members (two 72*a*, 72*c* of which are shown in FIG. 11) which are located so as to correspond to the respective reference portions 62*a*, 62*b*, 62*c*, whereby the positioning of the printing head 11 in the horizontal plane and in the height direction perpendicular to the horizontal plane is carried out. Since the printing head 11 has a generally rectangular shape in its plan view which is elongate in the direction of extension of the rows of the nozzle holes, the positioning of the printing head 11 is carried out on the basis of the three reference portions 62*a*-62*c* which are to contact the positioning members (two 72*a*, 72*c* of which are shown in FIG. 11), i.e., on the basis of the two reference portions 62*a*, 62*b* provided on respective two positions on the outer side surface of the first spacer plate 62 at its long side corresponding to the long side of the printing head 11 and the reference portion 62*c* provided on a position of the outer side surface of the first spacer plate 62 at its short side corresponding to the short side of the printing head 11. The plates 63-68 other than the first spacer plate 62 are formed with the cutouts 95-97 so as to correspond to the reference portions 62*a*, 62*b*, 62*c* with which the positioning members are to be in contact for positioning, so that the plates 63-68 do not contact the positioning members owing to the cutouts 95, 96, 97 and do not hinder the positioning of the printing head 11 on the jig 71.

The outer side surfaces of the intermediate plates 63-68 (i.e., the auxiliary plate 63, the two manifold plates 64, 65, the second spacer plate 66, the third spacer plate 67, and the base plate 68) may suffer from variations in configuration due to a tolerance of each component, and may not be accurately aligned with one another in the direction of stacking of the plates depending upon the accuracy with which those plates are stacked on and bonded to one another. In this instance, the outer side surfaces of those plates 63-68 may not be aligned with one another and suffer from protrusions and indents. By inhibiting the plates 63-68 from contacting the positioning members owing to the cutouts 95-97, however, it is possible to assure high positioning accuracy by contact of the positioning members on the jig 71 with the reference portions 62*a*-62*c*.

Thereafter, the head holder 12 is positioned with respect to the printing head 11 by positioning the head holder 12 on the jig 71. As described above, the head holder 12 has the plurality of reference portions X, Y, Z1-Z3 which are utilized in mounting the head holder 12 on the frame of the printing apparatus 100, in the leftward and rightward direction of the frame in which the head holder 12 slides, the frontward and backward direction perpendicular to the leftward and rightward direction of the frame, and the upward and downward direction of the frame perpendicular to the leftward and rightward direction. Described more specifically, the head holder 12 has the reference portion X in the sliding direction of the head holder 12, the reference portion Y in the frontward and backward direction perpendicular to the sliding direction, and the three reference portions Z1-Z3 in the upward and downward direction perpendicular to the sliding direction. The head holder 12 is positioned with respect to the printing head 11 by bringing those reference portions X, Y, Z1-Z3 into contact with respective positioning members on the jig 71. In FIG. 11, only the positioning members 73*a*-73*d* which are to be in contact with the respective reference portions, X, Z1-Z3 are shown. In other words, since the positioning members 73*b*, 73*c*, 73*d* are located so as to correspond to respective positions on the horizontal planes of the rear guide member 2A and the front guide member 2B and the positioning member (not shown) is located so as to correspond to the position on the vertical plane of the rear guide member 2A, the reference portions Z1-Z3 and Y of the head holder 12 are brought into contact with the positioning members 73*b*-73*d* and the positioning member not shown, respectively. Further, the reference portion X of the head holder 12 is brought into contact with a positioning member 73*a* in the sliding direction. Thus, the printing head 11 which has been already positioned on the jig 71 as described above is positioned with respect to the horizontal planes of the rear and front guide members 2A, 2B, the vertical plane of the rear guide member 2A, and the sliding direction of the head holder 12. As a result, the rows of the nozzle holes can be located at nominal positions relative to the head holder 12, disposed relative to a plane perpendicular to the sliding direction without inclination, and disposed in parallel to the print medium with a predetermined spacing therebetween. Thus, the printing head 11 can be fixed to the head holder 12 such that relative positional relationship between the plurality of reference portions 62*a*-62*c* of the printing head 11 and the plurality of reference portions X, Y, Z1-Z3 of the head holder 12 corresponds to predetermined positional relationship.

Thereafter, as shown in FIG. 7, a UV adhesive S is applied, through a plurality of apertures 12*c* formed in the bottom plate portion 12*a* of the head holder 12, onto the printing head 11 and is hardened by application of an ultraviolet ray thereto, so that the printing head 11 is bonded and fixed to the lower surface of the bottom plate portion 12*a* of the head holder 12. In this instance, as shown in FIG. 11, the flexible flat cable 20 is pulled upwardly through a slit 12*d* formed in the bottom plate portion 12*a* and a sealing material (not shown) is coated on the periphery of the slit 12*d*.

For increasing the bonding strength with which the head holder 12 formed by injection molding and the printing head 11 are bonded, the bonding portions of the head holder 12, i.e., the wall surfaces of the bottom plate portion 12*a* which define the apertures 12*c* and to which the adhesive is applied are subjected to a surface roughening treatment. For instance, the head holder 12 is molded by using molds whose molding surfaces are textured or by using a fiber-reinforced plastic in which glass fibers are mixed, and the glass fibers are exposed on the wall surfaces by lowering the temperature of the molds.

While the preferred embodiment of the present invention has been described above, it is to be understood that the invention is not limited to the details of the illustrated embodiment, but may be embodied with various other changes and modifications, which may occur to those skilled in the art, without departing from the spirit and scope of the invention.

In the illustrated embodiment, the plates 63-68 have cutouts 95-97 each as a recessed portion. The recessed portion is not limited to the cutout, but may be otherwise structured as long as it is possible to avoid contacting with the positioning member. For instance, portions of the outer side surfaces of the nozzle plate 61 and the plates 63-68 which correspond to the positioning members and which exclude the reference portions may be located inwardly of the reference portions.

Figure 10B:
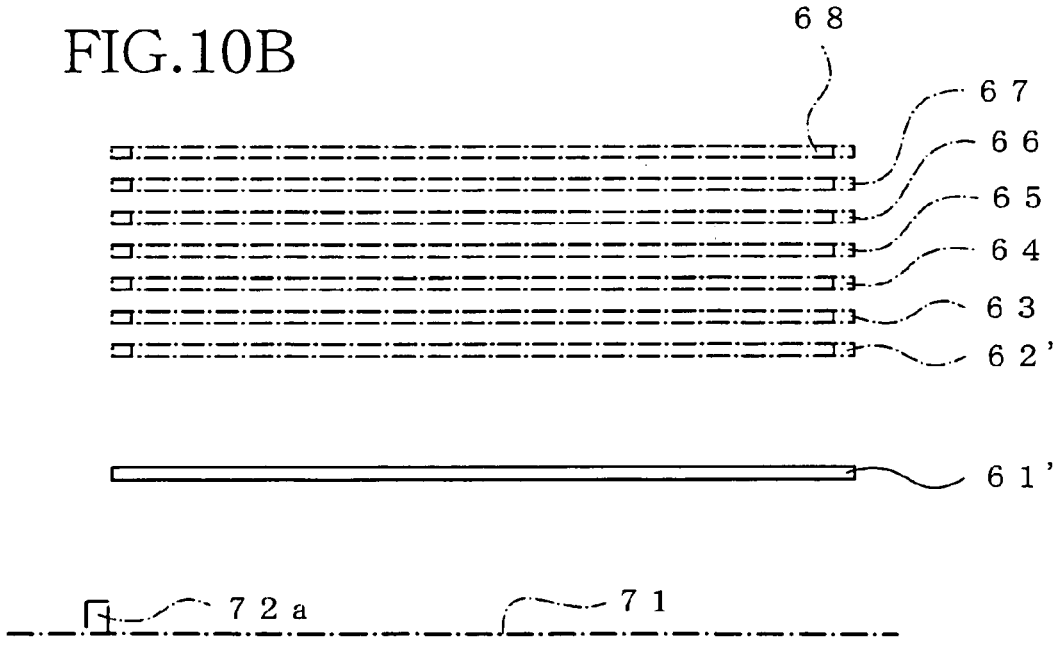

Instead of the reference portions 62*a*-62*c* provided on the outer side surface of the intermediate plate (the first spacer plate 62) which is superposed immediately on the nozzle plate 61 and which have through-holes or openings 90 corresponding to the nozzle holes 16*a*-16*d*, the reference portions may be provided on the outer side surface of the nozzle plate per se. The illustrated embodiment is explained with respect to a case where the nozzle plate (61) is formed of the synthetic resin. Where the nozzle plate (61') is formed of a metal, the nozzle holes are formed therein by press working, for instance, and the plurality of intermediate plates including the first spacer plate (62') are stacked on the nozzle plate (61'), as shown in FIG. 10B. In this instance, it is preferable to provide, on the outer side surface of the nozzle plate (61'), a plurality of reference portions.

As explained above, in the present invention, the printing head 11 is fixed to the head holder 12 on the basis of the reference portions provided on the outer side surface of the printing head 11, more specifically, on the basis of the reference portions provided on the outer side surface of the nozzle plate having the nozzle holes through which the inks are ejected for printing or any one of the intermediate plates, e.g., in the present embodiment, the first spacer plate 62 superposed immediately on the nozzle plate and having the through-holes 90 or openings corresponding to the nozzle holes. Therefore, the printing head 11 can be fixed to the head holder 12 while permitting the printing head (the nozzle plate) to be positioned relative to the head holder 12 at a reduced cost and with high accuracy.

In the illustrated embodiment, with the nozzle plate 61 bonded to the first spacer plate 62 which is superposed immediately thereon and which has the plurality of through-holes 90 formed therethrough in advance so as to correspond to the nozzle holes, the nozzle holes are formed through the nozzle plate 61 so as to be aligned with the through-holes 90 of the first spacer plate 62. Since the reference portions 62*a*-62*c* are provided on the outer side surface of the first spacer plate 62 superposed immediately on the nozzle plate 61 and having the through-holes 90 formed as described above, the printing head 11 is fixed to the head holder 12 on the basis of the reference portions 62*a*-62*c* while the nozzle holes can be economically and accurately positioned relative to the head holder 12.

In the illustrated embodiment, the nozzle plate 61 is formed of a synthetic resin while the first spacer plate 62 superposed immediately on the nozzle plate 61 is formed of a metal. In fixing the printing head 11 to the head holder 12 on the basis of the reference portions 62*a*-62*c* provided on the outer side surface of the first spacer plate 62, it is possible to obtain positioning accuracy necessary for fixing the printing head 11 to the head holder 12 even where the nozzle plate is formed of a synthetic resin.

In the illustrated embodiment, the reference portions 62*a*-62*c* are brought into contact with the respective positioning members in fixing the printing head 11 to the head holder 12 and portions of the outer side surface of the printing head 11, which portions correspond to the positioning members and which portions are other than the reference portions, are located inwardly of the reference portions. In other words, the plurality of reference portions 62*a*-62*c* of the printing head 11 are brought into contact with the respective positioning members when the printing head 11 is positioned relative to the head holder 12, and the portions of the outer side surface of the printing head 11 which correspond to the positioning members and which exclude the plurality of reference portions do not protrude outwardly of the reference portions. Further, the plurality of recessed portions 95-97 are formed in every intermediate plates 63-68 superposed on the intermediate plate 62 which has the plurality of reference portions 62*a*-62*c*, for avoiding contact with the positioning members. These mean that specific portions of the outer side surface of the printing head 11 which give the reference portions and with which the positioning members are to be in contact for positioning the printing head 11 to the head holder 12 may protrude outwardly of the portions of the outer side surface of the printing head 11 except the reference portions.

According to the above-described arrangement wherein the portions of the outer side surface of the printing head 11, which portions correspond to the positioning members and which portions are other than the reference portions, are located inwardly of the reference portions, it is possible to easily avoid contact of those portions other than the reference portions, with the positioning members, without performing any special working operation on the nozzle plate and the intermediate plates. Therefore, this arrangement is free from a risk of deteriorating the accuracy of positioning the printing head 11 due to the contact of the positioning members with those portions except the reference portions.

In the illustrated embodiment, the intermediate plates 63-68 superposed on the first spacer plate 62 having the reference portions 62*a*-62*c* are formed with recessed portions in the form of cutouts 95-97 (95*a*-95*f*, 96*a*-96*f*, 97*a*-97*f*) for avoiding contact with the positioning members. The recessed portions are configured to avoid the contact with the positioning members so as not to considerably lower the rigidity of the plates 63-68. According to this arrangement, the intermediate plates 63-68 are prevented from contacting the positioning members in positioning the printing head 11 by contact of the reference portions 62*a*-62*c* with the positioning members, thereby avoiding a risk of deteriorating accuracy of positioning the printing head 11.

In the illustrated embodiment, the printing head 11 has a generally rectangular shape in its plan view and the rows of the nozzle holes extend along the long side of the rectangular printing head 11, the printing head 11 can be accurately positioned in accordance with its rectangular shape on the basis of the three reference portions 62*a*-62*c*, two 62*a*, 62*b* of which are located at the respective two positions on the outer side surface of the printing head 11 at its long side and one 62*c* of which is located at the position on the outer side surface of the printing head 11 at its short side.

In the illustrated embodiment, the head holder 12 has the plurality of reference portions X, Y, Z1-Z3 on the basis of which the head holder 12 is positioned relative to the frame of the printing apparatus in the leftward and rightward direction of the frame in which the head holder 12 slides, the frontward and backward direction of the frame perpendicular to the leftward and rightward direction, and the upward and downward direction of the frame perpendicular to the leftward and rightward direction. Those reference portions of the head holder 12 are provided for permitting the head holder 12 to accurately function as a carriage which is reciprocated with the printing head 11 mounted thereon, and are suitably determined based on relationship with respect to the frame of the printing apparatus on which the head holder 12 is mounted. According to this arrangement, the printing head 11 can be accurately positioned relative to the frame with the head holder 12 mounted on the frame.

In the illustrated embodiment, with the nozzle plate 61 bonded to the first spacer plate 62 superposed immediately thereon and having the through-holes 90 corresponding to the nozzle holes, the nozzle holes are formed in the nozzle plate so as to be aligned with the through-holes 90 of the first spacer plate 62. Namely, the nozzle holes are formed on the basis of the reference portions 62*a*-62*c*. Accordingly, to position the printing head 11 relative to the head holder 12 by utilizing the reference portions 62*a*-62*c* provided on the outer side surface of the first spacer plate 62 superposed immediately on the nozzle plate 61 in fixing the printing head 11 to the head holder 12 is the same as to directly position the nozzle holes relative to the head holder 12. Therefore, the printing head 11 (the nozzle plate) can be fixed to the head holder 12 with high positioning accuracy.

As described above, the printing head 11 is fixed to the head holder 12 on the basis of the reference portions 62*a*-62*c* provided on the outer side surface of the printing head 11 (the first spacer plate 62), whereby the printing head 11 can be fixed to the head holder 12 while permitting economical and highly accurate positioning of the printing head 11 (the nozzle plate 61) to the head holder 12.

What is claimed is:

1. An ink-jet printing unit for an ink-jet printing apparatus, comprising:

an ink-jet printing head including a nozzle plate having a multiplicity of nozzle holes which are arranged in at least one row and from which ink is ejected, and a plurality of intermediate plates, which are superposed on the nozzle plate and which provide ink passages communicating with the nozzle holes; and a head holder which holds the ink-jet printing head, wherein the ink-jet printing head has, on an outer side surface thereof, a plurality of reference portions on the basis of which the ink-jet printing head is positioned relative to the head holder in fixing the ink-jet printing head to the head holder, the plurality of reference portions being provided on one of an outer side surface of the nozzle plate and an outer side surface of any one of the plurality of intermediate plates and structured to be brought into contact with a plurality of positioning members when the ink-jet printing head is positioned relative to the head holder, and wherein portions of the outer side surface of the ink-jet printing head, which correspond to the positioning members and which exclude the plurality of reference portions, do not protrude outwardly of the plurality of reference portions.

2. The ink-jet printing unit according to claim 1, wherein the plurality of reference portions are provided on the outer side surface of the nozzle plate.

3. The ink-jet printing unit according to claim 1, wherein the plurality of reference portions are provided on an outer side surface of one of the plurality of intermediate plates, which one intermediate plate is superposed immediately on the nozzle plate.

4. The ink-jet printing unit according to claim 3, wherein the one intermediate plate has a plurality of openings which correspond to the nozzle holes, and the nozzle holes are formed through the nozzle plate on the basis of any portion of the one intermediate plate, with the nozzle plate bonded to the one intermediate plate in which the plurality of openings are formed in advance.

5. The ink-jet printing unit according to claim 4, wherein the nozzle holes are formed on the basis of the plurality of reference portions.

6. The ink-jet printing unit according to claim 4, wherein the nozzle holes are formed on the basis of the plurality of openings formed in the one intermediate plate.

7. The ink-jet printing unit according to claim 1, wherein a plurality of recessed portions are formed in every intermediate plate or plates superposed on one of the nozzle plate and the any one of the plurality of intermediate plates which has the plurality of reference portions, for avoiding contact with the positioning members.

8. The ink-jet printing unit according to claim 1, wherein the nozzle plate is formed of a synthetic resin and the plurality of intermediated plates are formed of a metal.

9. The ink-jet printing unit according to claim 1, wherein the ink-jet printing head has, in its plan view, a substantially rectangular shape, and the plurality of reference portions are located at two respective positions on the outer side surface of the ink-jet printing head at a long side thereof and at one position on the outer side surface of the ink-jet printing head at a short side thereof.

10. The ink-jet printing unit according to claim 9, wherein the at least one row of the nozzle holes extends along the long side of the ink-jet printing head.

11. The ink-jet printing head according to claim 1, wherein the head holder has a plurality of reference portions on the basis of which the head holder is positioned relative to a frame of the ink-jet printing apparatus.

12. The ink-jet printing unit according to claim 11, wherein the plurality of reference portions of the head holder are utilized in positioning the head holder relative to the frame in a leftward and rightward direction of the frame in which the head holder slides, a frontward and backward direction of the frame perpendicular to the leftward and rightward direction, and an upward and downward direction of the frame perpendicular to the leftward and rightward direction.

13. The ink-jet printing unit according to claim 11, wherein the ink-jet printing head is fixed to the head holder such that relative positional relationship between the plurality of reference portions of the ink-jet printing head and the plurality of reference portions of the head holder corresponds to predetermined positional relationship.

* * * * *